US006140268A

United States Patent [19]

Yamazaki et al.

[11] Patent Number: 6,140,268

[45] Date of Patent: Oct. 31, 2000

[54] THERMAL TRANSFER IMAGE RECEIVING SHEET

[75] Inventors: Masayasu Yamazaki; Koichi Shirai; Masumi Nishizawa, all of Tokyo-To, Japan

[73] Assignee: Dai Nippon Printing Co., Ltd., Japan

[21] Appl. No.: 09/144,271

[22] Filed: Aug. 31, 1998

[30] Foreign Application Priority Data

Sep. 3, 1997 [JP] Japan ..... 9-252620

[51] Int. Cl.[7] ..... B41M 5/035; B41M 5/38

[52] U.S. Cl. ..... 503/227; 428/913; 428/914

[58] Field of Search ..... 8/471; 428/195, 428/913, 914; 503/227

[56] References Cited

FOREIGN PATENT DOCUMENTS

94/05506 3/1994 WIPO ..... 503/227

*Primary Examiner*—Bruce H. Hess

*Attorney, Agent, or Firm*—Parkhurst & Wendel, L.L.P

[57] ABSTRACT

A thermal transfer image receiving sheet is provided which causes none of offset of an antistatic agent, transfer of the antistatic agent onto a carrier roll of a thermal transfer printer, a lowering in whiteness of the thermal transfer image receiving sheet, and a remarkable lowering in coating strength under high humidity environment and possesses excellent and stable antistatic properties. The thermal transfer image receiving sheet comprises: a substrate sheet; a dye-receptive layer provided on at least one side of the substrate sheet; and a conductive layer as at least one layer provided between the substrate sheet and the receptive layer or as at least one layer provided on the substrate sheet in its side remote from the receptive layer. The conductive layer contains a conductive needle crystal. By virtue of the above constitution, the conductive layer possesses excellent adhesion to the substrate sheet and other layers and has high whiteness, and the thermal transfer image receiving sheet causes no change in properties, such as coating strength and the like, with environmental variations and possesses excellent antistatic properties.

12 Claims, No Drawings

THERMAL TRANSFER IMAGE RECEIVING SHEET

TECHNICAL FIELD

The present invention relates to an image receiving sheet for thermal transfer recording, and particularly to a thermal transfer image receiving sheet having excellent and stable antistatic properties for thermal dye transfer recording (sublimation transfer recording).

BACKGROUND OF THE INVENTION

Various thermal transfer recording methods have hitherto been known in the art. Among others, a thermal dye transfer recording method, wherein a thermal transfer sheet comprising a sublimable dye-containing thermal transfer layer provided on a support, such as a polyester film, is heated with a heating medium, such as a thermal head or a laser, to form an image on a thermal transfer image receiving sheet, has recently attracted attention and has been utilized as information recording means in various fields.

The thermal dye transfer recording method can form a full-color image, in a very short time, that has excellent halftone reproduction and gradation and high quality comparable to that of full-color photographic images.

In order to receive the sublimable dye being transferred from the thermal transfer sheet and to hold the formed image, a receptive layer formed of a thermoplastic resin, for example, a saturated polyester resin, a vinyl chloride/vinyl acetate copolymer, or a polycarbonate resin, and, if necessary, an intermediate layer are provided on an image receiving surface.

For example, when a highly rigid substrate sheet, such as PET, is used, a layer for imparting cushioning properties, or a layer for imparting antistatic properties, is provided as the intermediate layer.

A backside layer formed by coating a composition comprising a binder, such as an acrylic resin, and, added thereto, an organic filler of an acrylic resin, a fluororesin, a polyamide resin or the like and an inorganic filler, such as silica, is optionally provided on the backside from the viewpoint of preventing curling and improving slipperiness of the thermal transfer image receiving sheet.

The so-called "standard type" thermal transfer image receiving sheet is used in such a manner that the image receiving sheet is viewed through reflected light rather than transmitted light. Also in this case, an opaque, for example, white, PET, foamed PET, other plastic sheet, natural paper, synthetic paper, a laminate of these materials or the like is used as the substrate sheet.

On the other hand, the so-called "seal type" thermal transfer image receiving sheet comprising a substrate sheet, a receptive layer provided on one side of the substrate sheet, and an adhesive layer, formed of a pressure-sensitive adhesive, and release paper provided on the other side of the substrate sheet has also been used in various applications. The seal type thermal transfer image receiving sheet is used in such a manner that an image is formed on a receptive layer by thermal transfer, the release paper is separated and removed, and the receptive layer with an image formed thereon is then applied to a desired object.

It is known that an antistatic layer of a surfactant or the like is formed on the surface of a thermal transfer image receiving sheet. In this case, however, problems occur such as creation of tackiness of the thermal transfer image receiving sheet, migration of the antistatic agent from the top surface to the back surface, and transfer of the antistatic agent onto a carrier roll or the like of a thermal transfer printer.

Further, these problems in turn create a problem of a lowering in antistatic effect with the elapse of time.

Another method is to form a conductive layer using a conductive agent of a metal oxide, such as conductive carbon black or tin oxide, and a binder. In order to obtain electrical conductivity, these conductive agents should be added in a considerably large amount. In addition, in many cases, these conductive agents inherently have black or other color. Therefore, basically, use of the above conductive agents in an image receiving sheet results in lowered whiteness of the image receiving sheet, making it impossible to use these conductive agents.

In order to solve the above problems, the formation of an antistatic layer using an acrylic resin having a quaternary ammonium base has been proposed. Japanese Patent Laid-Open No. 139816/1990 proposes a method wherein an antistatic layer is formed using these materials between a receptive layer and a substrate. Since, however, these materials have poor water resistance, use thereof in above manner results in remarkably lowered coating strength under high humidity (particularly high temperature) environment, leading to problems including that the coating is broken due to friction between the thermal transfer image receiving sheet and the roll during carrying at the time of printing.

Further, basically, these materials have poor adhesion to the substrate and other resins. Therefore, materials usable in this case are considerably limited. An additional problem is that the antistatic properties vary depending upon environment.

DISCLOSURE OF THE INVENTION

Accordingly, an object of the present invention is to solve the above problems of the prior art and to provide a thermal transfer image receiving sheet that possesses excellent and stable antistatic properties, that is, is free from offset of the antistatic agent, is free from transfer of the antistatic agent onto a carrier roll or the like of a thermal transfer printer, causes no lowering in whiteness, and causes no remarkable lowering in coating strength under high humidity environment.

In order to attain the above object, according to one aspect of the present invention, there is provided a thermal transfer image receiving sheet comprising: a substrate sheet; a dye-receptive layer provided on at least one side of the substrate sheet; and a conductive layer as at least one layer provided between the substrate sheet and the receptive layer is not formed, the conductive layer containing a conductive needle crystal.

According to another aspect of the present invention, there is provided a thermal transfer image receiving sheet comprising: a substrate sheet; a dye-receptive layer provided on at least one side of the substrate sheet; and a conductive layer as at least one layer provided on the substrate sheet, the conductive layer being formed on the side where the receptive layer is not formed, the conductive layer containing a conductive needle crystal.

According to the present invention, the conductive needle crystal preferably has a fiber diameter of 0.1 to 1.0 $\mu$m, a fiber length of 1 to 20 $\mu$m, and an aspect ratio of not less than 10, the conductive needle crystal is preferably based on a $TiO_2$ compound, the conductive needle crystal is preferably based on $TiO_2$, the conductive needle crystal preferably comprises a $SnO_2$/Sb-based conductive agent, and the conductive needle crystal preferably has a lightness (L value) of not less than 60.

Further, the conductive needle crystal preferably has a lightness (L value) of not less than 80.

Further, the conductive layer preferably has a surface resistivity of $1.0\times10^4$ to $1.0\times10^{11}$ Ω/□ as measured in an environment of 23° C./60% and, when the receptive layer is provided thereon, has a surface resistivity of $1.0\times10^5$ to $1.0\times10^{12}$ Ω/□ as measured in an environment of 23° C./60%.

According to the present invention, in a thermal transfer image receiving sheet comprising a dye-receptive layer provided on at least one side of the substrate sheet, a conductive layer is provided as at least one layer between the substrate sheet and the receptive layer or as at least one layer provided on the surface of the substrate sheet remote from the receptive layer. Incorporation of a conductive needle crystal in the conductive layer permits the conductive layer to have excellent adhesion to the substrate sheet and high whiteness, and this can provide a thermal transfer image receiving sheet that is free from a change in properties, such as coating strength, with environmental variations and possesses excellent antistatic properties.

BEST MODE FOR CARRYING OUT THE INVENTION

Embodiments of the present invention will be described.

Substrate Sheet

The substrate sheet functions to support a receptive layer and, preferably, is not deformed by heat applied at the time of thermal transfer and has mechanical strength high enough to cause no troubles when handled in a printer or the like. Examples of materials for constituting the substrate sheet include, but are not limited to, films or sheets of various plastics, for example, polyesters, polyallylates, polycarbonates, polyurethane, polyimides, poyetherimides, cellulose derivatives, polyethylene, ethylene/vinyl acetate copolymer, polypropylene, polystyrene, poly(meth) acrylates, polyvinyl chloride, polyvinylidene chloride, polyvinyl alcohol, polyvinyl butyral, nylon, polyetheretherketone, polysulfone, polyethersulfone, tetrafluoroethylene/perfluoroalkyl vinyl ether copolymer, polyvinyl fluoride, tetrafluoroethylene/ethylene copolymer, tetrafluoroethylene/hexafluoropropylene copolymer, polychlorotrifluoroethylene, and polyvinylidene fluoride.

Besides the above plastic films or sheets, a white opaque film, prepared by adding a white pigment or a filler to the above synthetic resin and forming the mixture into a sheet, and a substrate sheet having therein microvoids. Further, various types of papers, such as capacitor paper, glassine paper, parchment paper, synthetic papers (such as polyolefin and polystyrene papers), wood free paper, art paper, coated paper, cast coated paper, paper impregnated with a synthetic resin or an emulsion, paper impregnated with a synthetic rubber latex, paper with a synthetic resin internally added thereto, and cellulose fiber paper.

Furthermore, laminates of any combination of the above substrate sheets may also be used. Representative examples of the laminate include a laminate of cellulose fiber paper and synthetic paper and a laminate of cellulose fiber paper and a synthetic paper of a plastic film.

At least one side of the above substrate sheets may have been subjected to treatment for improving the adhesion.

The effect of the present invention is particularly high when a substrate sheet based on a plastic having high electrification is used, although the substrate used in the present invention is not limited to this substrate only.

The thickness of the substrate sheet is generally about 3 to 300 μm. It, however, is preferably 75 to 175 μm from the viewpoint of mechanical properties and other properties. If the substrate sheet has poor adhesion to a layer provided thereon, the surface thereof may be subjected to adhesiveness-improving treatment or corona discharge treatment.

Conductive Layer

The conductive layer comprises a conductive needle crystal dispersed in a binder comprising a thermoplastic resin. The binder should be selected by taking the adhesion to the substrate sheet or other layer(s) and the dispersibility of the needle crystal. Examples of thermoplastic resins usable herein include polyolefin resins, polyester resins, urethane resins, polyacrylic resins, polyvinyl alcohols, epoxy resins, butyral resins, polyamide resins, polyether resins, and polystyrene resins. Among them, urethane resins are preferred from the viewpoints of adhesion to the substrate, dispersibility and the like. Commercially available urethane resins usable herein include various urethane resins, for example, Nippollan manufactured by Nippon Polyurethane Industry Co., Ltd.

The conductive needle crystal can be prepared by treating the surface of a needle crystal with a conductive agent.

Needle crystals usable herein include potassium titanate, titanium oxide, aluminum borate, silicon carbide, and silicon nitride. The needle crystal is preferably a $TiO_2$-based compound from the viewpoint of allowing the conductive layer to be white colored. The stability with respect to dispersion should be further taken into consideration. From the viewpoint of the stability of the conductivity with respect to the dispersion strength, $TiO_2$ is excellent because it is high in hardness. When the hardness is low, the crystal is broken at the time of dispersion, leading to a problem of lowered conductivity and, in addition, a problem of a change in conductivity with a slight fluctuation in dispersion at the time of preparation of a coating.

Conductive agents usable herein include conventional ones, such as $SnO_2$/Sb-based, $InO_2$/Sn-based, and ZnO/Al-based conductive agents. $SnO_2$/Sb-based conductive agents are most preferred from the viewpoints of conductivity, stability, cost and the like.

Factors governing the conductivity include the size of the conductive needle crystal and the amount of the conductive needle crystal added. In general, the conductive needle crystal has a fiber diameter of 0.05 to 3 μm, a fiber length of 1 to 200 μm, and an aspect ratio of 10 to 200. A higher aspect ratio is more advantageous for the conductivity and can offer satisfactory conductivity in a smaller amount of the conductive needle crystal added. However, a fiber diameter of 0.1 to 1.0 μm, a fiber length of 1 to 20 μm, and an aspect ratio of 10 to 50 are preferred from the viewpoint of the dispersibility, stability, and coatability with a fiber diameter of 0.1 to 0.3 μm, a fiber length of 1 to 6 μm, and an aspect ratio of 10 to 20 being most preferred.

The aspect ratio refers to fiber length/fiber diameter.

The amount of the conductive needle crystal added may be about 1 to 500% by weight based on the resin binder. When the amount is excessively small, no stable conductivity is provided, while an excessively large amount is disadvantageous from the viewpoint of cost and often poses a problem of coloration.

For this reason, the amount of the conductive needle crystal added is preferably 10 to 200% by weight, most preferably 20 to 100% by weight, based on the resin binder.

The coverage of the conductive needle crystal is also one of the factors governing the conductivity, and the conductive needle crystal may be coated at a coverage in the range of 0.1 to 10 g/m$^2$ on a dry basis. In this case, when the coverage is below or exceeds the above range, the same problems as described in connection with the amount of the conductive needle crystal added. For this reason, the coverage is preferably 0.5 to 5 g/m$^2$, most preferably 1 to 3 g/m$^2$.

Various pigments, dyes, fluorescent brighteners, and other additives may be added to the conductive layer on such a level that will not detrimental to the conductivity.

When the conductive layer is provided on the surface of the substrate sheet remote from the receptive layer, the lightness (L value) of the conductive needle crystal is preferably not less than 60. When the conductive layer is provided as at least one layer between the substrate sheet and the receptive layer, the lightness (L value) of the conductive needle crystal is preferably not less than 80.

The reason why a difference in lightness (L value) of the crystal is provided between when the conductive layer is provided on the surface of the substrate sheet remote from the receptive layer (L value:60 or more) and when the conductive layer is provided as at least one layer between the substrate sheet and the receptive layer (L value:80 or more) is that good appearance and sharper image can be provided by rendering the whiteness of the thermal transfer image receiving sheet on its image forming side higher than the white of the sheet on its backside in which no image is formed.

The lightness (L value) of the conductive needle crystal is the lightness (L value) of the crystal per se and is measured by a method specified in JIS Z 8722 and expressed by a method specified in JIS Z 8730.

Receptive Layer

The receptive layer according to the present invention comprises at least one thermoplastic resin and is provided on at least one side of the substrate sheet. The receptive layer functions to receive a sublimable dye being transferred from the thermal transfer sheet and to hold the resultant thermally transferred image.

Thermoplastic resins usable in the receptive layer include, for example, halogenated polymers, such as polyvinyl chloride and polyvinylidene chloride, vinyl resins, such as polyvinyl acetate, ethylene/vinyl acetate copolymer, vinyl chloride/vinyl acetate copolymer, polyacrylic ester, polystyrene, and polystyrene (meth)acrylate, acetal resins, such as polyvinyl formal, polyvinyl butyral, and polyvinyl acetal, various saturated and unsaturated polyester resins, polycarbonate resins, cellulosic resins, such as cellulose acetate, polyolefin resins, urea resins, melamine resins, and polyamide resins, such as benzoguanamine resins. These resins may be used alone or as a blend of two or more so far as they are compatible with each other or one another.

Among the above thermoplastic resins, thermoplastic resins having active hydrogen are preferred. Preferably, the active hydrogen is present in the end of the thermoplastic resin from the viewpoint of stability of the thermoplastic resin. When the vinyl resin is used, the content of the vinyl alcohol is preferably not more than 30% by weight.

If necessary, other various additives may be added to the receptive layer. Pigments or fillers, such as titanium oxide, zinc oxide, kaolin, clay, calcium carbonate, and finely divided silica, may be added from the viewpoint of improving the whiteness of the receptive layer and further enhancing the sharpness of the transferred image.

If necessary, plasticizers, ultraviolet absorbers, light stabilizers, antioxidants, fluorescent brighteners, antistatic agents and other conventional additives may be added to the receptive layer.

The receptive layer may be optionally formed by adding the resin, the release agent, and, if necessary, additives and the like, satisfactorily kneading the mixture together in a solvent, a diluent or the like to prepare a coating liquid for a receptive layer, coating the coating liquid onto the substrate sheet by a receptive layer forming method, such as gravure printing, screen printing, or reverse roll coating using a gravure plate, and drying the coating to form a receptive layer.

The coating of the intermediate layer, backside layer, and adhesive layer described below may be coated by the same method as described in connection with the formation of the receptive layer.

The present invention can be applied also to the seal type thermal transfer image receiving sheet comprising a substrate sheet, a receptive layer provided on one side of the substrate sheet, and an adhesive layer, formed of a pressure-sensitive adhesive, and a release paper provided on the other side of the substrate sheet. The adhesive layer may be formed by the same method as described in connection with the formation of the receptive layer.

The following antistatic agent may also be incorporated into the coating liquid for a receptive layer from the viewpoint of imparting the antistatic properties.

Antistatic agents: fatty esters, sulfuric esters, phosphoric esters, amides, quaternary ammonium salts, betaines, amino acids, acrylic resins, ethylene oxide adducts and the like.

The amount of the antistatic agent added is preferably 0.1 to 2.0% by weight based on the resin.

According to the thermal transfer image receiving sheet of the present invention, the coverage of the receptive layer is preferably 0.5 to 4.0 g/m$^2$ on a dry weight basis. When the coverage is less than 0.5 g/m$^2$ on a dry weight basis, poses the following problem. Specifically, when the receptive layer is provided directly on the substrate sheet, the adhesion to a thermal head is unsatisfactory due to rigidity of the substrate sheet and other factors, resulting in the formation of a rough image surface in highlight areas. This problem can be avoided by providing an intermediate layer for imparting cushioning properties. The presence of the intermediate layer, however, lowers the scratch resistance of the receptive layer. Roughening of the surface upon application of high energy is likely to relatively increase with an increase in the coverage of the receptive layer. When the coverage exceeds 4.0 g/m$^2$ on a dry weight basis, the high density area has a slightly dark view at the time of OHP projection.

In the present invention, the coverage is on a dry weight basis and a value expressed in terms of solid content, unless otherwise specified.

Backside Layer

A backside layer may be provided on the surface of the substrate sheet remote from the receptive layer from the viewpoint of mainly improving the carriability of the thermal transfer image receiving sheet and preventing curling of the thermal transfer image receiving sheet. The backside layer having such functions may comprise: a resin such as an acrylic resin, a cellulosic resin, a polycarbonate resin, a polyvinyl acetal resin, a polyvinyl alcohol resin, a polyamide resin, a polystyrene resin, a polyester resin, or a halogenated polymer; and, added to the resin, an organic filler, such as an acrylic filler, a polyamide filler, a fluorocarbon filler, or a polyethylene wax, or an inorganic filler, such as silicon dioxide or a metal oxide.

Use of the above resin, which has been cured with a curing agent, as the backside layer is preferred. The curing agent may be generally a conventional one. Among others, an isocyanate compound is preferred. When the resin for the backside layer is reacted with an isocyanate compound or the like to form a urethane bond, thereby curing the resin and forming a three-dimensional structure, the heat resistance, storage stability and solvent resistance can be improved and, at the same time, the adhesion of the backside layer to the substrate sheet is improved. The amount of the curing agent added is preferably 1 to 2 equivalents per equivalent of reaction group of the resin. When the amount is less than 1 equivalent, the crosslinking is unsatisfactory and, in addition, the heat resistance and the solvent resistance are deteriorated. On the other hand, when the amount exceeds 2 equivalents, problems occur such as a change in the backside layer with the elapse of time due to the residual curing agent and a decrease in pot life of the coating liquid for a backside layer.

Organic or inorganic fillers may be optionally added as additives to the backside layer. These fillers function to improve the carriability of the thermal transfer image receiving sheet in a printer and to prevent blocking of the thermal transfer image receiving sheet, that is, to improve the storage stability of the thermal transfer image receiving sheet.

Organic fillers usable herein include acrylic fillers, polyamide fillers, fluorocarbon fillers, and polyethylene wax. Among them, polyamide fillers are particularly preferred. Inorganic fillers usable herein include silicon dioxide and metal oxides.

The polyamide filler is preferably such that the molecular weight is 100000 to 900000, the shape is spherical, and the average particle diameter is 0.01 to 30 $\mu$m. The polyamide filler is more preferably such that the molecular weight is 100000 to 500000 and the average particle diameter is 0.01 to 10 $\mu$m. For the type of the polyamide filler, nylon 12 filler is more preferable than nylon 6 and nylon 66 by virtue of better water resistance and freedom from a change in properties upon water absorption.

The polyamide filler has a high melting point, is thermally stable, has good oil resistance and chemical resistance, and is less likely to be dyed with a dye. When the molecular weight is 100000 to 900000, the filler is not substantially abraded, possesses a self-lubricating property, has a low coefficient of friction, and is less likely to damage a counter material.

The average particle diameter is preferably 0.1 to 30 $\mu$m. When the particle diameter is excessively small, the filler is hidden by the backside layer, making it difficult to develop satisfactory slipperiness. On the other hand, when the particle diameter is excessively large, the particle is excessively protruded from the backside layer, unfavorably resulting in enhanced coefficient of friction and separation of the filler from the backside layer.

The proportion of the filler incorporated into the backside layer is preferably 0.01 to 200% by weight based on the resin. In the case of the thermal transfer image receiving sheet for a reflection image, the proportion is more preferably 1 to 100% by weight. When the proportion of the filler incorporated is less than 0.01% by weight, slipperiness is unsatisfactory, often causing troubles, such as paper jamming at the time of paper feeding into a printer. On the other hand, when the proportion of the filler incorporated exceeds 200% by weight, the slipperiness becomes so high that, disadvantageously, a color shift is likely to occur in the printed image.

Adhesive Layer

An adhesive layer formed of an adhesive resin, such as an acrylic ester resin, a polyurethane resin, or a polyester resin, may be coated on at least one side of the substrate sheet. Alternatively, at least one side of the substrate sheet with the coating not provided thereon may be subjected to corona discharge treatment to enhance the adhesion between the substrate sheet and the overlying layer.

The following examples and comparative examples further illustrate the present invention but are not intended to limit it.

EXAMPLE 1

A 100 $\mu$m-thick white PET film (Lumirror, manufactured by Toray Industries, Inc.) was provided as a substrate sheet. A coating liquid 1, for a conductive layer, having the following composition was coated by means of a Mayer bar on one side of the substrate sheet at a coverage on a dry basis of 2.0 g/m$^2$, and the coating was dried to form a conductive layer.

| <Coating liquid 1 for conductive layer> | Solid content ratio (% by weight) |
|---|---|
| Conductive needle crystal (FT-1000, manufactured by Ishihara Sangyo Kaisha Ltd.) (average fiber diameter 0.13 $\mu$m, average fiber length 1.68 $\mu$m, aspect ratio 12.9, base material of crystal $TiO_2$, conductive agent for crystal $SnO_2$/Sb, lightness of crystal (L value) 85 to 91) | 20.0 |
| Polyurethane resin (Nippollan N-5199, manufactured by Nippon Polyurethane Industry Co., Ltd.) | 20.0 |
| Methyl ethyl ketone | 25.0 |
| Toluene | 25.0 |
| IPA | 10.0 |

Next, a coating liquid 1, for a receptive layer, having the following composition was coated on the surface of the conductive layer at a coverage on a dry basis of 4.0 g/m$^2$, and the coating was dried to form a receptive layer.

| <Coating liquid 1 for receptive layer> | Solid content ratio (% by weight) |
|---|---|
| Vinyl chloride/vinyl acetate copolymer (#1000A, manufactured by Denki Kagaku Kogyo K.K.) | 19.6 |
| Silicone (X62-1212, manufactured by The Shin-Etsu Chemical Co., Ltd) | 2.0 |
| Catalyst (CAT-PL-50T, manufactured by The Shin-Etsu Chemical Co., Ltd) | 0.2 |
| Methyl ethyl ketone | 39.1 |
| Toluene | 39.1 |

A coating liquid 1, for a backside layer, having the following composition was coated on the surface of the substrate sheet remote from the receptive layer at a coverage on a dry basis of 1.5 g/m$^2$, and the coating was dried to form a backside layer. Thus, a thermal transfer image receiving sheet of Example 1 according to the present invention was prepared.

| <Coating liquid 1 for backside layer> | Solid content ratio (% by weight) |
|---|---|
| Acryl resin (BR 85, manufactured by Mitsubishi Rayon Co., Ltd.) | 19.8 |
| Nylon filler (MW-330, manufactured by Shinto Paint Co., Ltd.) | 0.6 |
| Methyl ethyl ketone | 39.8 |
| Toluene | 39.8 |

EXAMPLE 2

The procedure of Example 1 was repeated, except that a coating liquid 2, for a conductive layer, having the following composition was used instead of the coating liquid 1 for a conductive layer in Example 1. Thus, a thermal transfer image receiving sheet of Example 2 according to the present invention was prepared.

| <Coating liquid 2 for conductive layer> | Solid content ratio (% by weight) |
|---|---|
| Conductive needle crystal (FT-3000, manufactured by Ishihara Sangyo Kaisha Ltd.) (average fiber diameter 0.27 $\mu$m, average fiber length 5.15 $\mu$m, aspect ratio 19.1, base material of crystal $TiO_2$, conductive agent for crystal $SnO_2$/Sb, lightness of crystal (L value) 90 to 95) | 20.0 |
| Polyurethane resin (Nippollan N-5199, manufactured by Nippon Polyurethane Industry Co., Ltd.) | 20.0 |
| Methyl ethyl ketone | 25.0 |
| Toluene | 25.0 |
| IPA | 10.0 |

EXAMPLE 3

The procedure of Example 1 was repeated, except that a coating liquid 3, for a conductive layer, having the following composition was used instead of the coating liquid for a conductive layer in Example 1. Thus, a thermal transfer image receiving sheet of Example 3 according to the present invention was prepared.

| <Coating liquid 3 for conductive layer> | Solid content ratio (% by weight) |
|---|---|
| Conductive needle crystal (Dentall WK-200, manufactured by Otsuka Chemical Co., Ltd. (fiber diameter 0.2 to 0.5 $\mu$m, fiber length 10 to 20 $\mu$m, base material of crystal: potassium titanate, conductive agent for crystal: $SnO_2$/Sb, lightness of crystal (L value) not less than 73) | 10.0 |
| Titanium oxide (TCA-888, manufactured by Tohchem Products Corporation) | 10.0 |
| Fluorescent brightener (Uvitex OB, manufactured by CIBA-GEIGY CO.) | 1.0 |
| Polyurethane resin (Nippollan N-5199, manufactured by Nippon Polyurethane Industry Co., Ltd.) | 10.0 |

-continued

| <Coating liquid 3 for conductive layer> | Solid content ratio (% by weight) |
|---|---|
| Methyl ethyl ketone | 27.0 |
| Toluene | 27.0 |
| IPA | 15.0 |

EXAMPLE 4

A 100 $\mu$m-thick white PET film (Lumirror, manufactured by Toray Industries, Inc.) was provided as a substrate sheet. A coating liquid 1 for a conductive layer used in Example 1 was coated by means of a Mayer bar on one side of the substrate sheet at a coverage on a dry basis of 2.0 g/m$^2$, and the coating was dried to form a conductive layer.

The coating liquid 1 for a backside layer used in Example 1 was then coated on the surface of the conductive layer at a coverage on a dry basis of 1.5 g/m$^2$, and the coating was dried to form a backside layer.

The coating liquid 1 for a receptive layer used in Example 1 was coated on the surface of the substrate sheet remote from the conductive layer at a coverage on a dry basis of 4.0 g/m$^2$, and the coating was dried to form a receptive layer. Thus, a thermal transfer image receiving sheet of Example 4 of the present invention was prepared.

EXAMPLE 5

The procedure of Example 1 was repeated, except that a conductive layer was formed between the backside layer and the substrate sheet by coating the coating liquid 1 for a conductive layer by means of a Mayer bar at a coverage on a dry basis of 2.0 g/m$^2$ and then drying the coating. Thus, a thermal transfer image receiving sheet of Example 4 of the present invention was prepared.

COMPARATIVE EXAMPLE 1

The procedure of Example 1 was repeated, except that no conductive layer was provided. Thus, a thermal transfer image receiving sheet of Comparative Example 1 was prepared.

In order to examine the carriability of the thermal transfer image receiving sheet, the thermal transfer image receiving sheets of the examples of the present invention and comparative examples and a commercially available thermal dye transfer sheet were used to form images by means of a CP-2000 printer manufactured by Mitsubishi Electric Corporation. In this case, the surface resistivity of each of the thermal transfer image receiving sheet was measured before and after the formation of the image by means of the printer. Further, before the image formation, the whiteness of the thermal transfer image receiving sheet on its receptive layer side was measured.

Specific evaluation methods are as follows.

(Carriability)

For 10 sheets of each thermal transfer image receiving sheet, the sheets were continuously fed into and carried through the printer to evaluate the carriability. The evaluation criteria are as follows.

O: No trouble

X: Jammed within the printer (Surface Resistivity)

The surface resistivity of the thermal transfer image receiving sheet on its receptive layer side (top surface) and on its backside was measured with a high resistivity measuring device manufactured by Advantest Co., Ltd. under an environment of temperature 23° C. and relative humidity 60% and under an environment of temperature 0° C. and unspecified humidity (free) before the formation of an image by means of the printer. Further, after the formation of an image by means of the printer, the surface resistivity of the thermal transfer image receiving sheet on its receptive layer side (top surface) and on its backside was measured with the high resistivity measuring device under an environment of temperature 23° C. and relative humidity 60%.

(Whiteness)

Reflecting properties of each thermal transfer image receiving sheet on its receptive layer side was measured with a color difference meter manufactured by Minolta CR-221 by a method specified in JIS Z 8722, and L value was determined as whiteness by a method specified in JIS Z 8730.

(Results of Evaluation)

The results of evaluation are summarized in Tables 1 and 2.

TABLE 1

| | Surface resistivity (Ω/□) | | |
|---|---|---|---|
| | Before image formation | | After image formation |
| | 23° C./60% | 0° C./free | 23° C./60% |
| Ex. 1 | $5.6 \times 10^6$<br>$>1.0 \times 10^{14}$ | $5.6 \times 10^6$<br>$>1.0 \times 10^{14}$ | $5.7 \times 10^6$<br>$>1.0 \times 10^{14}$ |
| Ex. 2 | $5.4 \times 10^6$<br>$>1.0 \times 10^{14}$ | $5.4 \times 10^6$<br>$>1.0 \times 10^{14}$ | $5.7 \times 10^6$<br>$>1.0 \times 10^{14}$ |
| Ex. 3 | $6.0 \times 10^6$<br>$>1.0 \times 10^{14}$ | $6.0 \times 10^6$<br>$1.0 \times 10^{14}$ | $5.9 \times 10^6$<br>$1.0 \times 10^{14}$ |
| Ex. 4 | $>1.0 \times 10^{14}$<br>$4.5 \times 10^6$ | $>1.0 \times 10^{14}$<br>$4.4 \times 10^6$ | $>1.0 \times 10^{14}$<br>$4.5 \times 10^6$ |
| Ex. 5 | $8.0 \times 10^7$<br>$4.2 \times 10^6$ | $8.0 \times 10^7$<br>$4.2 \times 10^6$ | $8.0 \times 10^7$<br>$4.2 \times 10^6$ |
| Comp. Ex. 1 | $>1.0 \times 10^{14}$<br>$>1.0 \times 10^{14}$ | $>1.0 \times 10^{14}$<br>$>1.0 \times 10^{14}$ | $>1.0 \times 10^{14}$<br>$>1.0 \times 10^{14}$ |

The upper numeral value represents the surface resistivity of the thermal transfer image receiving sheet on its receptive layer side (top surface), while the lower numeral value represents the surface resistivity of the thermal transfer image receiving sheet on its backside.

TABLE 2

| | Carri-ability | White-ness (%) | Others | Overall evaluation |
|---|---|---|---|---|
| Ex. 1 | ○ | 88 | | ○ |
| Ex. 2 | ○ | 92 | | ○ |
| Ex. 3 | ○ | 77 | Stability of conductive coating liquid was somewhat poor, and there was a little variation in antistatic resin. | Δ |
| Ex. 4 | ○ | 88 | Antistatic properties were somewhat poor due to the absence of conductive layer on the substrate sheet in its receptive layer side. | ○–Δ |
| Ex. 5 | ○ | 88 | | ○ |
| Comp. Ex. 1 | X | 88 | Severe electrification during printing | X |

(Overall evaluation) ○: Excellent Δ: Good X: Failure

As is apparent from the above results, for the thermal transfer image receiving sheets of Examples 1 to 3 wherein a conductive layer was provided between the substrate sheet and the receptive layer, the surface resistivity of the receptive layer in the image receiving sheet was stable against environmental variations, such as temperature and humidity variations. Further, these thermal transfer image receiving sheets were stable against the image formation, that is, there was no significant change in the surface resistivity between before the image formation and after the image formation. For the thermal transfer image receiving sheet of Example 4 wherein a conductive layer was formed between the substrate sheet and the backside layer, the surface resistivity of the backside layer in the image-receiving sheet was stable against environmental variations, such as temperature and humidity variations. Further, this thermal transfer image receiving sheet was stable against the image formation, that is, there was no change in the surface resistivity between before the image formation and after the image formation. For the thermal transfer image receiving sheet of Example 5 wherein a conductive layer was formed on the surface of substrate sheet remote from the receptive layer (that is, formed between the substrate sheet and the backside layer), the surface resistivity on the receptive layer side of the image-receiving sheet and the surface resistivity on the backside layer side of the image-receiving sheet were stable against environmental variations, such as temperature and humidity variations. Further, this thermal transfer image receiving sheet was stable against the image formation, that is, there was no change in the surface resistivity between before the image formation and after the image formation. Why the surface resistivity of the image-receiving sheet was measured before and after the image formation is that when an antistatic layer is formed using a surfactant or the like on the surface of the thermal transfer image receiving sheet, the antistatic agent is transferred onto a carrier roll or the like of a thermal transfer printer to cause a change in surface resistivity between before and after the image formation.

For the thermal transfer image receiving sheet of Comparative Example 1 wherein the conductive layer is provided on neither the receptive layer side nor the back side, the surface resistivity is high and not stable. This led to paper jamming during carrying in a printer, making it impossible to normally perform image formation.

The coating liquid for a conductive layer used in Example 3 caused a gradual increase in viscosity with the elapse of time, that is, somewhat lacked in stability. As with the thermal transfer image receiving sheets of the other examples, the thermal transfer image receiving sheet of Example 3 had excellent carriability and stability of the whiteness and surface resistivity.

For the thermal transfer image receiving sheet of Example 4 wherein a conductive layer was formed between the substrate sheet and the backside layer and no conductive layer was formed between the substrate sheet and the receptive layer, the whiteness on the receptive layer side was low.

For the thermal transfer image receiving sheet of Comparative Example 1, the whiteness of the surface of the receptive layer was so low that the appearance was not good.

As described above, according to the present invention, in a thermal transfer image receiving sheet comprising a dye-receptive layer provided on at least one side of the substrate sheet, a conductive layer is provided as at least one layer between the substrate sheet and the receptive layer or as at least one layer provided on the surface of the substrate sheet remote from the receptive layer. Incorporation of a conductive needle crystal in the conductive layer permits the conductive layer to have excellent adhesion to the substrate sheet or other layer(s) and high whiteness, and this can provide a thermal transfer image receiving sheet that is free from offset of an antistatic agent, free from transfer of an antistatic agent onto a carrier roll or the like of a thermal transfer printer, causes no lowering in whiteness of the thermal transfer image receiving sheet, and no remarkable lowering in coating strength in an environment of high humidity, that is, has excellent and stable antistatic properties.

The thermal transfer image receiving sheet of the present invention, because it has excellent antistatic properties during image formation, can prevent carrying troubles, such as jamming (paper jamming) and double feeding, and at the same time can prevent troubles, associated with dropouts of a print caused by attraction of dust or the like.

What is claimed is:

1. A thermal transfer image receiving sheet comprising:

a substrate sheet;

a dye-receptive layer provided on at least one side of the substrate sheet; and a conductive layer as at least one layer provided between the substrate sheet and the receptive layer, the conductive layer containing a conductive needle crystal.

2. A thermal transfer image receiving sheet according to claim 1, wherein the conductive needle crystal has a fiber diameter of 0.1 to 1.0 $\mu$m, a fiber length of 1 to 20 $\mu$m, and an aspect ratio of not less than 10.

3. A thermal transfer image receiving sheet according to claim 1, wherein the conductive needle crystal is based on a $TiO_2$ compound.

4. The thermal transfer image receiving sheet according to claim 1, wherein the conductive needle crystal is based on $TiO_2$.

5. The thermal transfer image receiving sheet according to claim 1, wherein the conductive needle crystal further comprises a $SnO_2$/Sb-based conductive agent.

6. The thermal transfer image receiving sheet according to claim 1, wherein the conductive needle crystal has a lightness (L value) of not less than 80.

7. The thermal transfer image receiving sheet according to claim 1, wherein the conductive layer has a surface resistivity of $1.0\times10^4$ to $1.0\times10^{11}$ Ω/□ as measured in an environment of 23° C./60% and, when the receptive layer is provided thereon, has a surface resistivity of $1.0\times10^5$ to $1.0\times10^{12}$ Ω/□ as measured in an environment of 23° C./60%.

8. A thermal transfer image receiving sheet comprising:

a substrate sheet;

a dye-receptive layer provided on at least one side of the substrate sheet; and a conductive layer as at least one layer provided on the substrate sheet, the conductive layer being provided on the side where the receptive layer is not formed, the conductive layer containing a conductive needle crystal.

9. The thermal transfer image receiving sheet according to claim 8, wherein the conductive needle crystal has a lightness (L value) of not less than 60.

10. The thermal transfer image receiving sheet according to claim 8, wherein the conductive needle crystal has a fiber diameter of 0.1 to 1.0 $\mu$m, a fiber length of 1 to 20 $\mu$m, and an aspect ratio of not less than 10.

11. The thermal transfer image receiving sheet according to claim 8, wherein the conductive needle crystal is based on a $TiO_2$ compound.

12. The thermal transfer image receiving sheet according to claim 8, wherein the conductive needle crystal is based on $TiO_2$.

* * * * *